US006752599B2

(12) United States Patent
Park

(10) Patent No.: US 6,752,599 B2
(45) Date of Patent: Jun. 22, 2004

(54) APPARATUS FOR PHOTORESIST DELIVERY

(75) Inventor: Jino Park, San Jose, CA (US)

(73) Assignee: aLink M, Inc., Milpitas, CA (US)

( * ) Notice: Subject to any disclaimer, the term of this patent is extended or adjusted under 35 U.S.C. 154(b) by 0 days.

(21) Appl. No.: 09/879,791

(22) Filed: Jun. 11, 2001

(65) Prior Publication Data

US 2003/0095870 A1 May 22, 2003

Related U.S. Application Data

(60) Provisional application No. 60/210,665, filed on Jun. 9, 2000.

(51) Int. Cl.[7] ..... F04B 45/053; F04B 49/00
(52) U.S. Cl. ..... 417/46; 417/395
(58) Field of Search ..... 417/18, 46, 187, 417/395

(56) References Cited

U.S. PATENT DOCUMENTS 4,483,665 A 11/1984 Hauser ..... 417/401
4,950,134 A 8/1990 Bailey et al. ..... 417/383
5,201,636 A * 4/1993 Mikulski ..... 417/18
5,262,068 A 11/1993 Bowers et al. ..... 210/767
5,527,161 A 6/1996 Bailey et al. ..... 417/53
5,932,987 A 8/1999 McLoughlin ..... 318/696
6,105,829 A 8/2000 Snodgrass et al. ..... 222/214
6,126,403 A * 10/2000 Yamada ..... 417/46
6,158,966 A * 12/2000 Guespin et al. ..... 417/46
6,238,576 B1 5/2001 Yajima ..... 210/767
6,416,295 B1 * 7/2002 Nagai et al. ..... 417/187

* cited by examiner

*Primary Examiner*—Michael Koczo
(74) *Attorney, Agent, or Firm*—Larry Williams

(57) ABSTRACT

A controller for a photoresist dispense pump is described that actively monitors the operation of the pump and dynamically determines completion of the refill of the pump. In one embodiment, pressure measurements are made during the refill step. Changes in the pressure measurements are used to indicate completion of the refill. After refill is completed, the refill step is terminated and the operation cycle is continued.

16 Claims, 7 Drawing Sheets

APPARATUS FOR PHOTORESIST DELIVERY

CROSS-REFERENCE

The present application claims priority from U.S. Provisional Patent Application No. 60/210,665, filed on Jun. 9, 2000. U.S. Provisional Patent Application No. 60/210,665, filed on Jun. 9, 2000 is incorporated herein, in its entirety, by this reference.

BACKGROUND

This invention relates to improved methods and apparatus for dispensing chemicals for process operations. More specifically, the invention relates to methods and apparatus for photoresist delivery for processing semiconductor wafers.

The buildings and equipment required for processing high-value substrates such as electronic devices on semiconductor wafers are expensive. Such manufacturing processes are technologically challenging because of the high degree of precision needed for carrying out the processes and the requirement for a high level of cleanliness in the fabrication environment. Consequently, the investment cost of a modern operation for fabricating integrated circuits can cost over a billion dollars. The operation of facilities for fabrication of integrated circuits is also expensive because of utilities that are required such as high purity inert gas needed for purging equipment and other applications to support the clean environment.

Photolithography processes are essential in the production of most electronic devices. The nature of the photolithography process makes it particulate challenging. An important element of the photolithography process is the application of photoresist materials to substrates such as semiconductor wafers. In order to meet the demanding requirements for fabricating integrated circuits, the photoresist materials must be applied in very exact amounts. In addition, the photoresist materials need to be of extremely high purity so as to prevent contamination of the wafer surface with particles and other contaminants.

Some of the problems and potential solutions associated with the delivery of photoresist materials have been addressed before. U.S. Pat. No. 5,527,161 provides solutions to the problem of delivering precise amounts of photoresist materials to wafers; the patent also addresses the problem of providing particle free photoresist to the wafer. U.S. Pat. No. 4,950,124 describes a precision liquid dispenser using a displacement diaphragm pump and a hydraulic system for selectively deforming the diaphragm. A stepper motor and control system are described in U.S. Pat. No. 5,932,987 for controlling the volume of photoresist delivery to wafers.

Diaphragm pumps have gained wide acceptance for use in the delivery of photoresist to wafers. An example of a commercially available diaphragm pump suitable for such operations is made by the Millipore Corporation, the WCDS and WCDP P/R Pump models.

Although problems such as control of the delivery amount and purity of photoresist materials have been addressed, progress towards improving the efficiency of the photoresist delivery process has been weak or nonexistent. The standard control schemes for delivering photoresist with diaphragm pumps use a fixed time interval for controlling the pump refill step. The time interval for the refill steps are based on the viscosity of the chemical being delivered. Typically, the time interval for the refill step is set to 12 seconds for low viscosity chemicals and to 30 seconds for high viscosity chemicals. The standard methods use fixed time intervals even though the refill may be completed in less than the allocated fixed time. In other words, the standard methods and apparatus employ a very simple control scheme that may use more time than necessary to complete one of the steps required for photolithography.

As stated earlier, the investment cost and operating cost for electronic device fabrication are very high. It is important for the overall operation to operate as efficiently as possible so as to reduce the per unit cost for products and to generally improve the cost of ownership of the manufacturing operation. Even a small unnecessary waste, on a per wafer basis, can lead to significant additional operating expenses. In addition, the standard methods and apparatus for photoresist delivery are typically unsophisticated and matters such as failure detection and defect avoidance are unavailable.

Clearly, there is a need for improved methods and apparatus for photoresist delivery for applications such as processing semiconductor wafers for electronic device fabrication. There is a need for increased throughput and increased reliability for applications such as applying photoresist to semiconductor wafers during wafer processing operations. There is a need for improved operating efficiency for equipment used to deliver photoresist so that less time is wasted during wafer processing. Furthermore, there is a need for more sophisticated photoresist delivery equipment that can facilitate error detection and troubleshooting of the photoresist delivery equipment and process.

SUMMARY

This invention seeks to provide methods and apparatus that can overcome deficiencies in known technologies used for dispensing chemicals such as for dispensing photoresist materials during semiconductor device fabrication.

One aspect of the present invention includes methods and apparatus for controlling a chemical dispense pump such as a chemical dispense pump used for dispensing photoresist materials onto wafers. The methods and apparatus includes actively monitoring the status of the dispense pump so that the dispense pump can be controlled in response to changes that occur during operation of the pump. According to one embodiment of the present invention, the refill step is actively monitored so as to determine the completion of the refill step so that the refill step can be terminated and the next step can be started with a reduction in unnecessary delay. A further embodiment includes methods and apparatus for measuring the pressure, more specifically, the level of vacuum applied to the chemical dispense pump for drawing the chemical into the pump for refill. The pressure is measured with resolutions that are sufficient to allow identification of the changes in the pressure that correspond to completion of the refill step.

In one embodiment of the present invention, the chemical dispense pump includes a diaphragm for moving the chemical. A pneumatic valve is arranged in communication with the diaphragm so as to drive the diaphragm. The apparatus includes a sensor for monitoring the position of the diaphragm. The sensor is connected with the pump. The apparatus further includes a controller; the controller is responsive to the sensor and provides control signals to the pneumatic valve so as to control dispensing the chemical.

As a further example, the sensor uses pressure to monitor the position of the diaphragm. The monitoring of the diaphragm's position is determined by a pressure threshold. For example, the sensor can be arranged to measure pressure, more specifically the level of vacuum, between the diaphragm and the vacuum source. For example, the controller can be arranged to terminate the refill step when the pressure measurements indicate that the refill has been completed; consequently, the controller is able to start the next step upon completion of the refill step.

One example of a suitable sensor is a pressure sensor such as a semiconductor pressure sensor that converts pressure readings into voltage signals.

One example of a suitable controller is a microprocessor. In one embodiment, a microprocessor may be configured so as to be capable of controlling multiple chemical dispense pumps.

In one embodiment, the method includes monitoring the position of a diaphragm in a chemical dispensing pump such as Millipore's Waferguard WCDS and WCDP. In a further embodiment, the position of the diaphragm is monitored by monitoring the pressure between the diaphragm and the vacuum source associated with controlling the diaphragm. The controller is arranged to terminate the refill step when the pressure measurements indicate that the refill has been completed; consequently, the controller is able to start the next step upon completion of the refill step. Optionally, the next that can be started without unnecessary delay.

Yet another aspect of the present invention includes methods and apparatus for monitoring a chemical dispense pump so that malfunctions of the chemical dispense pump can be detected. In one, embodiment the apparatus includes a pressure sensor arranged to measure pressure applied to valves and/or diaphragms used for moving and controlling the movement of the chemical being dispensed. The pressure sensor is connected with a controller responsive to the pressure sensor so that variations in the pressure with respect to time do not conform to predetermined variations, then an alarm is triggered and/or operation of the chemical dispense pump is suspended until the chemical dispense pump is checked for a possible malfunction.

It is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be used as a basis for designing other structures, methods, and systems for carrying out aspects of the present invention. It is important, therefore, that the claims be regarded as including such equivalent constructions insofar as they do not depart from the spirit and scope of the present invention.

The above and still further features and advantages of the present invention will become apparent upon consideration of the following detailed descriptions of specific embodiments thereof, especially when taken in conjunction with the accompanying drawings.

DESCRIPTION

The invention pertains to a controller and to methods of operating a controller for controlling pumps for delivering a chemical such as delivery of photoresist to a wafer. The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
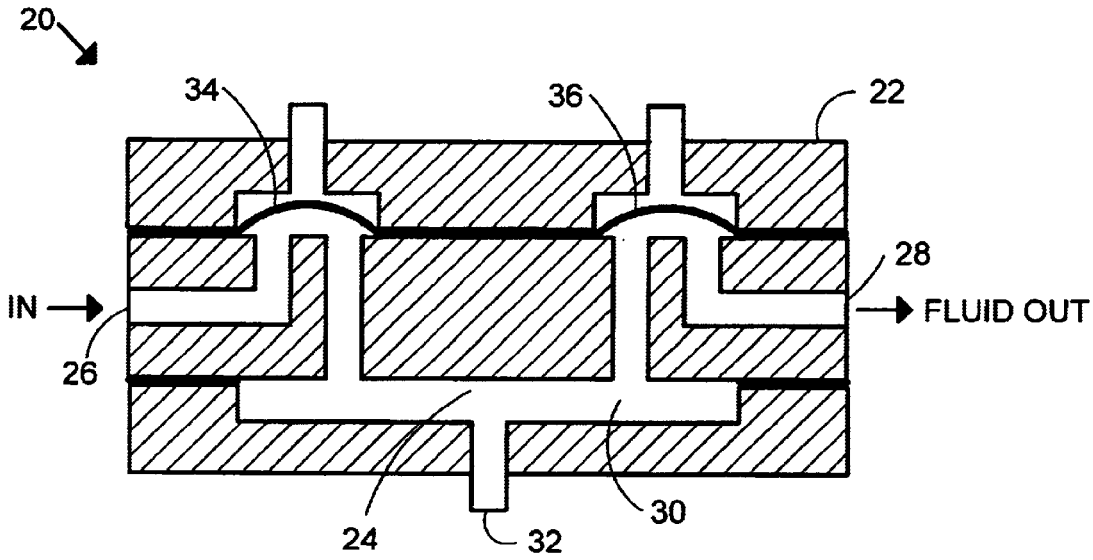
PRIOR ART FIG. 1
FIG. 1 is a diagram of a standard chemical dispense pump that can be controlled using embodiments of the present invention.

Reference is now made to FIG. 1 wherein there is shown a diagram of a standard diaphragm pump 20 used for delivering photoresist to wafers as part of photolithography processes. Pumps of the type shown in FIG. 1 are commercially available from companies like Millipore Corporation. Pump 20 includes a pump body 22 having a cavity 24 for holding the photoresist. Pump body 22 also has an inlet port 26 for the fluids to enter cavity 24 and an outlet port 28 for fluids to exit cavity 24. Inlet port 26 and outlet port 28 are in fluid communication with cavity 24 so that fluid can enter inlet port 26 and pass through cavity 24 and exit outlet port 28.

Pump 20 includes a primary diaphragm 30 arranged to provide a side enclosure for cavity 24 so that movement of the diaphragm causes fluid to be drawn into cavity 24 or dispensed from cavity 24. Pump 22 has a port 32 for application of pressure or a vacuum to one side of primary diaphragm 30 so as to cause the motion of primary diaphragm 30 that results in drawing liquid into cavity 24 or dispensing liquid from cavity 24. Diaphragm pump 20 is configured so that application of vacuum to port 32 causes fluid to be drawn into cavity 24 as occurs during the refill step. Further, diaphragm pump 28 is configured so that application of pressure to port 32 causes fluid to be dispensed from cavity 24 during the dispense or delivery step.

Pump body 22 further includes an inlet diaphragm valve 34 for controlling the entry of fluids into cavity 24. Pump body 22 further includes an outlet diaphragm valve 36 for controlled to exit of fluids from cavity 24. Of course, other types of valves can be used for controlling the inlet and exit of fluids to and from cavity 24. Pump the 22 has ports associated with diaphragm valve 34 and diaphragm valve 36 so that pressure or vacuum can be applied to valve 34 and valve 36 to cause them to open or close upon command.

As stated earlier, diaphragm pump 20 is a standard type of pump used in the fabrication of integrated circuits. In the standard operating process, the refill step is executed by closing outlet valve 36, opening inlet valve 34, and applying vacuum, i.e. a reduced pressure, to the port 32 so that primary diaphragm 30 causes fluid to be drawn into cavity 24. In the standard practice, the refill step will be maintained for a fixed predetermined interval of time depending on the viscosity of the fluid being drawn into cavity 24. The fixed time interval typically selected is 12 seconds for low viscosity liquid and 30 seconds for high viscosity liquid. Also, as indicated earlier the fixed time interval is maintained even if the refill step is completed in less time than the fixed time.

In the standard operating process, the dispense step is executed by closing valve 34, opening valve 36, and applying pressure at port 32. The pressure applied at port 32 causes primary diaphragm 30 to move so that fluid is dispensed from cavity 24. Additional steps such as idle and suck back are also typically included as part of the cycle of refill and dispense of the photoresist.

Embodiments of the present invention include methods and apparatus for controlling diaphragm pumps such as that described in FIG. 1.

Figure 2:
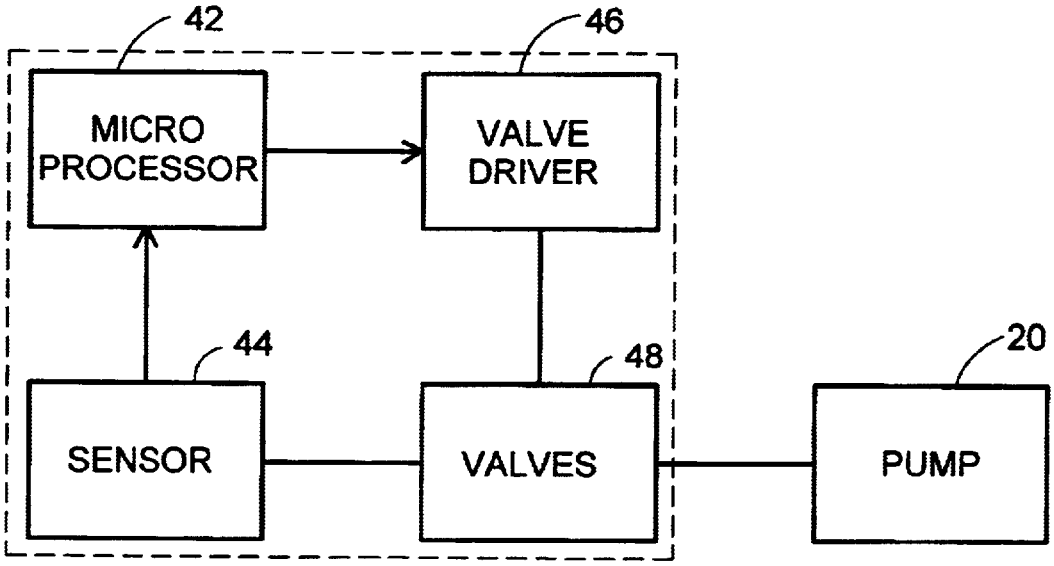
FIG. 2 is a schematic diagram of an embodiment of the present invention.

Reference will now be made to FIG. 2 wherein there is shown a block diagram of a diaphragm pump controller 38 according to one embodiment of the present invention. Controller 38 includes a microprocessor 42, a sensor 44, a valve driver 46, and one or more valves 48. FIG. 2 shows controller 38 connected with a diaphragm pump 20 so that controller 38 can control the refill and the dispense operations of pump 20. Pump 20 shown in FIG. 2 is substantially the same as that described for pump 20 shown in FIG. 1.

Microprocessor 42 is a standard type of microprocessor capable of executing steps in a computer program. Microprocessor 42 is also capable of receiving signals and responding to signals by sending information or commands. Microprocessor 42 is capable of providing commands for controlling valve driver 46. Valve driver 46 is connected with microprocessor 42 to allow commands to be transmitted from microprocessor 42 to valve driver 46.

Valve driver 46 is connected with valves 48 to cause valves 48 to open or close according to the commands from microprocessor 42. A variety of types of valves may be included in valves 48. In one embodiment, valves 48 comprise solenoid valves. In addition, it is to be understood that the number of and arrangements of individual valves comprising valves 48 are a matter of designer choice so long as valves 48 are capable of the necessary switching for carrying out the commands from microprocessor 42.

Sensor 44 is capable of measuring a property that represents the status of an aspect of the refill step that occurs in pump 20. Sensor 44 is connected with microprocessor 42 so as to provide information of the measured property to microprocessor 42 so that microprocessor 42 can monitor the operation of diaphragm pump 20. For the embodiment shown in FIG. 2, sensor 44 is in fluid communication with pump 20 via valves 48. Preferably, sensor 44 comprises pressure sensor and sensor 44 is in fluid communication with port 32 so that sensor 44 can measure the pressure at port 32 of pump 20 during the refill step.

It is to be understood that the application of pressure and the application of vacuum to port 32, valve 34, and valve 36 is accomplished using a pressure source (not shown in FIG. 2) and a vacuum source (not shown in FIG. 2), respectively. Preferably, the vacuum source is capable of achieving a vacuum of at least 10 inches of mercury, and the pressure source is capable of providing sufficient pressure to operate primary diaphragm 30, valve 34, and valve 36. In one embodiment, valves 48 are arranged so as to be able to switch vacuum or pressure to port 32, valve 34, and valve 36 in response to commands from microprocessor 42 applied to valves 48 via valve driver 46.

In one embodiment, sensor 44 connects with the vacuum source so that sensor 44 can provide measurements of the level of vacuum generated by the vacuum source. This means that during the refill step, when vacuum is provided to port 32, sensor 44 measures the level of vacuum that is applied to cause refill to occur. During the dispense step, when pressure is applied to port 32, sensor 44 is isolated from the pressure source; sensor 44 continues to measure the level of vacuum generated by the vacuum source during the dispense step. In a preferred embodiment, sensor 44 comprises a semiconductor pressure sensor, which converts pressure measurements to electrical voltage signals. The electrical voltage signals are applied to microprocessor 42 as described earlier.

One embodiment of the present invention controls the refill step of pump 20 by monitoring the position of bottom diaphragm 30. The position of bottom diaphragm 30 is related to the level of vacuum measured at port 32. Sensor 44 provides measurements of the level of vacuum during the refill step. Upon completion of the refill step, there is an abrupt change in the level of vacuum measured by sensor 44. The change in the level vacuum may be referred to as a pressure threshold; the pressure threshold corresponds to about the completion of the refill. After detecting the pressure threshold, pump 20 can be allowed to proceed to the next step that follows the refill step. In one embodiment, the pressure measurements are made every microsecond; of course, longer or shorter sampling times may be used so long as the sampling time provides the necessary signal resolution to detect the threshold.

Figure 3:
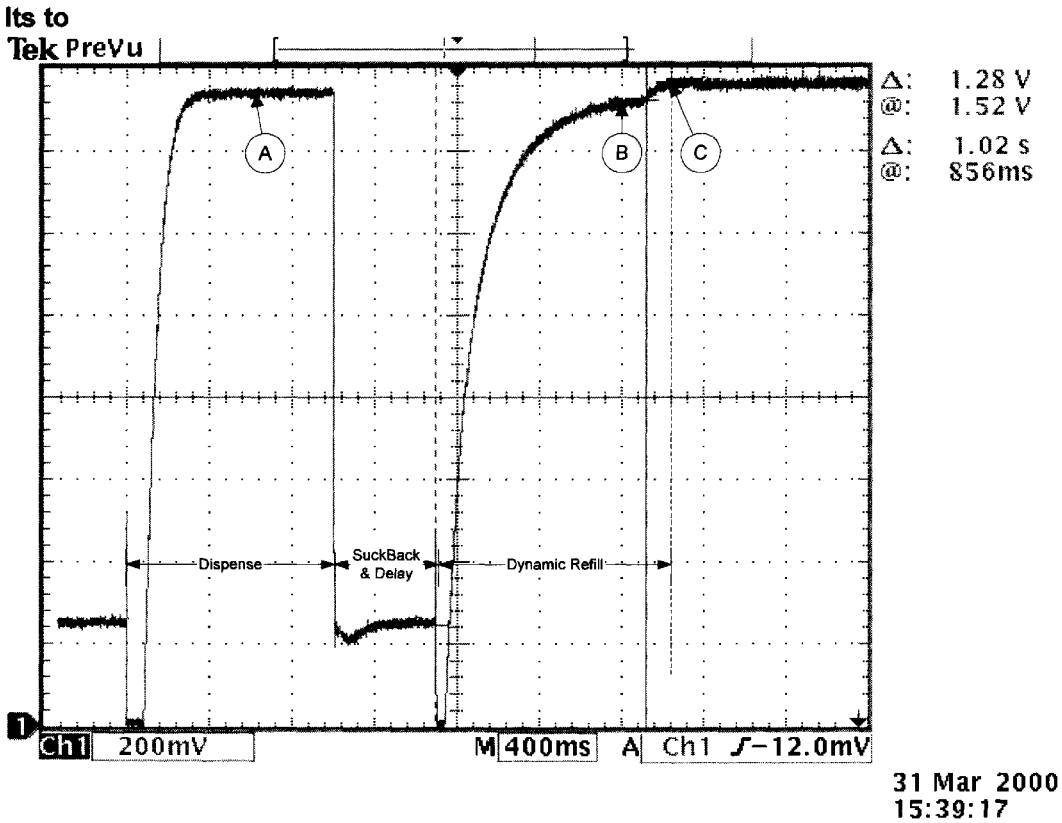
FIG. 3 is an image of pressure vs. time data for illustrating the operation of an embodiment of the present invention

A more detailed description of the operation of an embodiment of the present invention will now be made with reference to FIG. 3. Shown in FIG. 3 is an image of measurements made using an oscilloscope; the image shows the pressure measurements (y axis) from sensor 44 as a function of time (x axis) during a dispense and refill cycle controlled by controller 38. FIG. 3 shows a full cycle of pressure data measured at the vacuum source; the time interval for the measurements include a one sec dispense at 10 psi, suck back and delay step, and refill step. The reference pressure, the threshold pressure, and the refill completion are indicated in FIG. 3.

During the dispense step, microprocessor 42 receives a signal from sensor 44 indicating the level vacuum created by the vacuum source. The level of vacuum measured during the dispense step is used as a reference pressure for identifying the threshold pressure that occurs during the refill step. The reference pressure is indicated by the arrow extending from point A in FIG. 3. Then, in the following refill step, microprocessor 42 controls the refill time based on the reference pressure while monitoring the signals received from sensor 44. Microprocessor 42 compares the pressure signals from sensor 44 with the reference pressure and determines when the pressure indicated by the signals from sensor 44 shows that the level of vacuum has exceeded that of the reference pressure. The pressure that occurs just prior to having the level of vacuum exceed that of the reference pressure corresponds to the threshold pressure. The threshold pressure is approximately indicated by the arrow extending from point B in FIG. 3.

As can be seen in FIG. 3, the level vacuum increases after the pressure threshold is reached. At about the time that the pressure increase begins to level off, the refill is complete and the refill step can be terminated; the arrow extending from point C in FIG. 3 indicates a suitable point for terminating the refill step. In other words, microprocessor 42 ends the refill time when the monitored level of vacuum is just above the reference value such as is indicated by point C in FIG. 3. After the refill step is finished, controller 38 can then have pump 20 begin the step following the refill step.

In experiments using an embodiment of the present invention, the refill was found to be completed in about two to three seconds for a high viscosity photoresist under conditions for which the standard technology would set a fixed refill time of 30 seconds. This means that using embodiments of the present invention under those conditions, possibly as much as about 28 seconds can be reduced from the time allowed for the refill step. This results in a significant time savings on a per wafer basis for integrate circuit manufacturing operations.

In contrast to embodiments of the present invention, the standard technology is inefficient and wastes large amounts of time during the refill step. In preferred embodiments of the present invention, the step following the refill step is started within less than about 12 seconds after detecting completion of the refill step for low viscosity chemicals. For high viscosity chemicals, preferred embodiments of the present invention start the step following the refill step within less than about 30 seconds after detecting completion of the refill step.

FIG. 3 can also be used to illustrate a different approach in applying aspects of the present invention. Point C indicated in FIG. 3 is near an inflection point. Embodiments of the present invention may include methods and apparatus for determining approximately or substantially exactly when point C occurs by identifying inflection points near point C. In some embodiments of the present invention, microprocessor 42 may be programmed and used to identify inflection points in the pressure vs. time measurements to determine when the refill is complete. Suitable methods for determining inflection points are commonly known and can easily be implemented in computing devices such as microprocessor 42. If the inflection points are used as the basis for determining completion of the refill step then it may be unnecessary to obtain measurements of the reference pressure as described in an earlier example embodiment.

Furthermore, it is to be noted that point B, shown in FIG. 3, is also near an inflection point; point B can also be identified or approximated using methods for identifying inflection points. Some embodiments of the present invention may identify the inflection point near point B as a preliminary step to identifying or approximating point C.

In addition to automatically detecting completion of the refill step, embodiments of the present invention are particularly suited to photoresist delivery operations in which the conditions of the photoresist delivery change. For example, if the pressure used during the dispense step is changed then the time required for completion of the refill will change also, typically. As a result of the capability of embodiments of the present invention to actively monitor completion of the refill, changes in the dispense process conditions are automatically handled when the refill step is being controlled.

Embodiments of the present invention also offer another valuable capability that is unavailable in the standard technology. Specifically, the use of microprocessor 42, or equivalent electronic device, allows the controller to monitor and react to other operating conditions of pump 20. Microprocessor 42 can be configured to aid in failure detection and troubleshooting. An important advantage of this capability is the possibility of being able to avoid improperly processing wafers. A misprocessed wafer can result in a substantial financial loss. Furthermore, if an improperly operating photoresist pump causes multiple wafers to be misprocessed then the financial loss is also multiplied by the number of wafers.

Possible failures for photoresist dispense pumps such as pump 20 include failures in the primary diaphragm so that there are leaks, failures in the connections and tubing for the vacuum lines and pressure lines so that there are leaks, and failures in the diaphragm valves. Specific problems that can be detected include leaks in the vacuum lines, leaks in the gas lines, leaks in the diaphragm, loose gas line connections, low supply pressure, tube damage, and diaphragm damage.

Microprocessor 42 may be programmed to be responsive to unusual signals provided by sensor such as sensor 44. In other words, if a measured level of vacuum provided by sensor 44 is not what it is to be expected, then microprocessor 42 may provide an alarm or suspend operations until the system has been examined. In this way, further misprocessing of wafers can be avoided.

Figure 4:
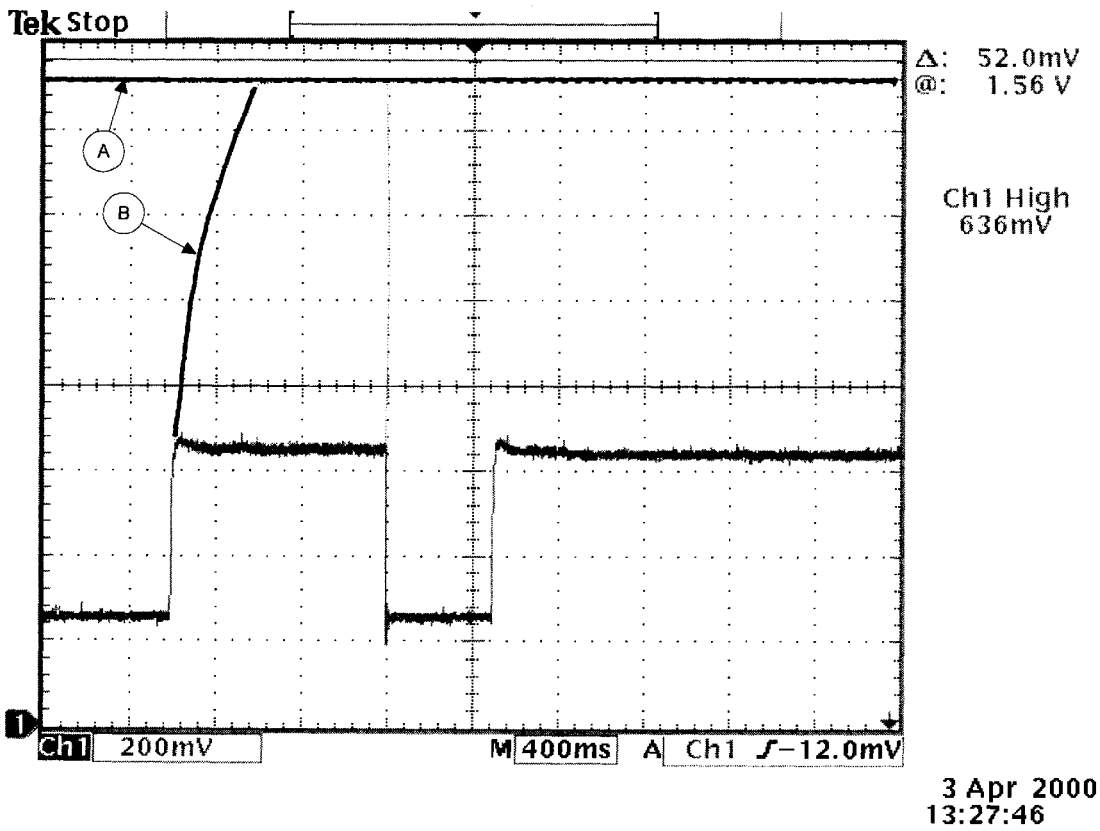
FIG. 4 is an image of pressure vs. time data for illustrating the operation of an embodiment of the present invention.
Figure 5:
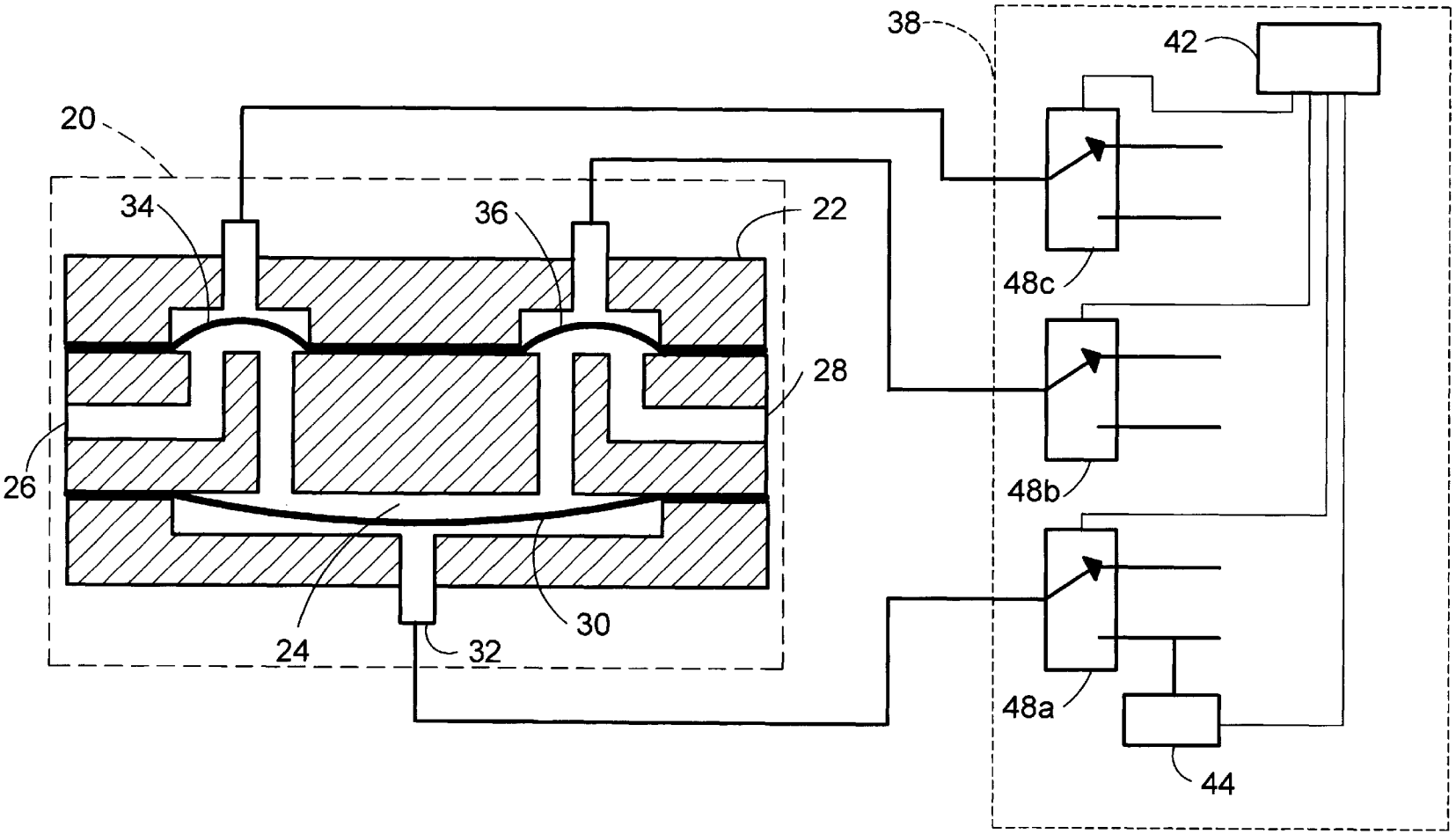
FIG. 5 is a diagram of a pump and a controller according to one embodiment of the present invention.

An example of failure detection can be seen in FIG. 4 wherein there is shown measured data provided by sensor 44 during a malfunction of the operation of pump 20. FIG. 4 shows an image of obtained using an oscilloscope to measure pressure vs. time when primary diaphragm 30 is damaged. Point A in FIG. 4 represents the pressure level for normal operation. During normal operation, the pressure should change as indicated by curve B to reach the pressure level indicated by point A. However, because of the malfunction, the measured pressure shown in FIG. 4 does not reach the pressure indicated by point A. The failure to reach the proper pressure can be detected quickly using microprocessor 42 and one or more pressure sensors to monitor the pressures used in operating the dispense pump. Consequently, losses caused by pump malfunctions can be significantly reduced by using embodiments of the present invention Reference is now made to FIG. 5 where there is shown a diagram of a pump 20 and a controller 38 according to one embodiment of the present invention. Pump 20 and controller 38 are substantially the same as those described for FIG. 2 with the exception of illustrating some additional details. Controller 38 shown in FIG. 5 includes a microprocessor 42, a sensor 44, and valves that include valve 48*a*, valve 48*b*, and valve 48*c*. The valves are coupled to microprocessor 42 so that microprocessor 42 can command the switching of the valves. The valves are configured for switching between a pressure source or a vacuum source (pressure source and vacuum source not shown in FIG. 5) so as to provide pressure or vacuum required for operating pump 20. The valves are in fluid communication with ports such as port 32 on pump 20. Preferably, the fluid communication between the valves and the ports on pump 20 is accomplished using tubing. For the embodiment shown in FIG. 5, valve 48*a* is connected between sensor 44 and port 32. Sensor 44 is arranged so as to provide pressure measurements of the vacuum source connected with valve 48*a*. In other words, when valve 48*a* switches the vacuum source to port 32, sensor 44 measures the pressure of the vacuum source applied to port 32 of pump 20. Sensor 44 is connected with microprocessor 42 for providing pressure measurement signals to microprocessor 42.

Figure 6:
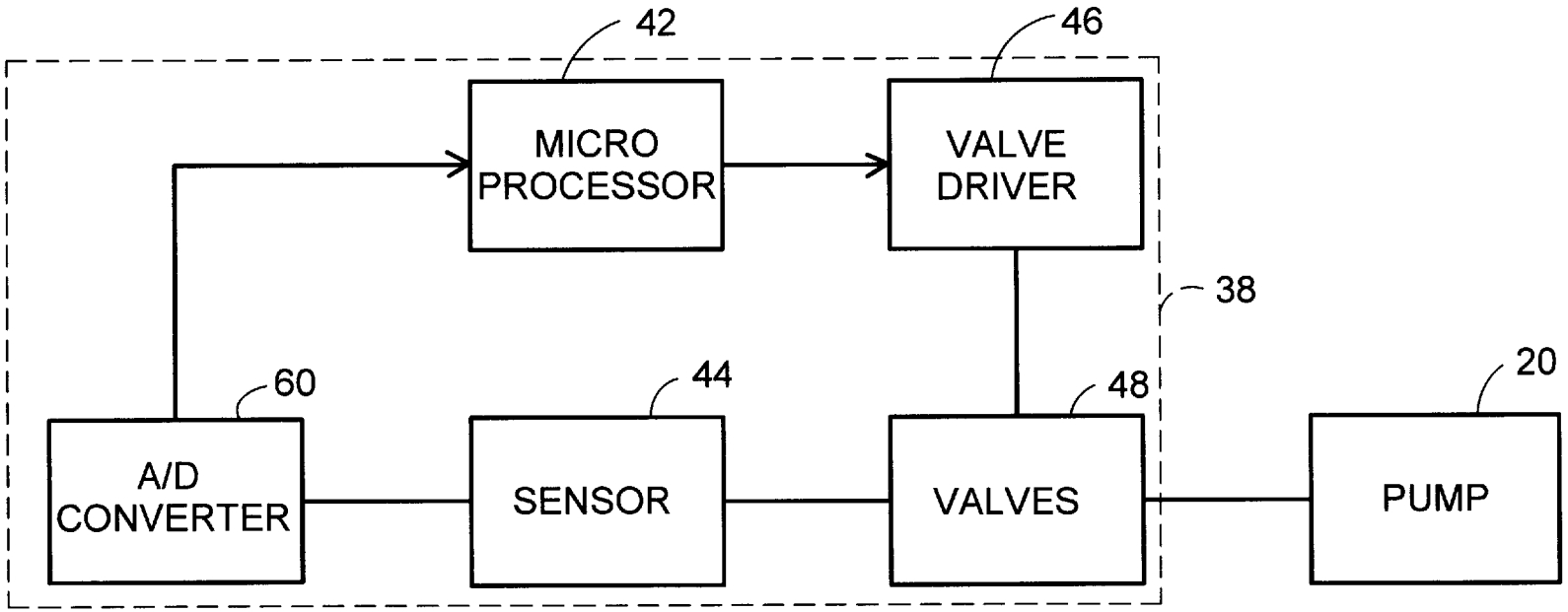
FIG. 6 shows an embodiment of the present invention that includes an analog-to-digital converter in addition to the elements shown in FIG. 2.
Figure 7:
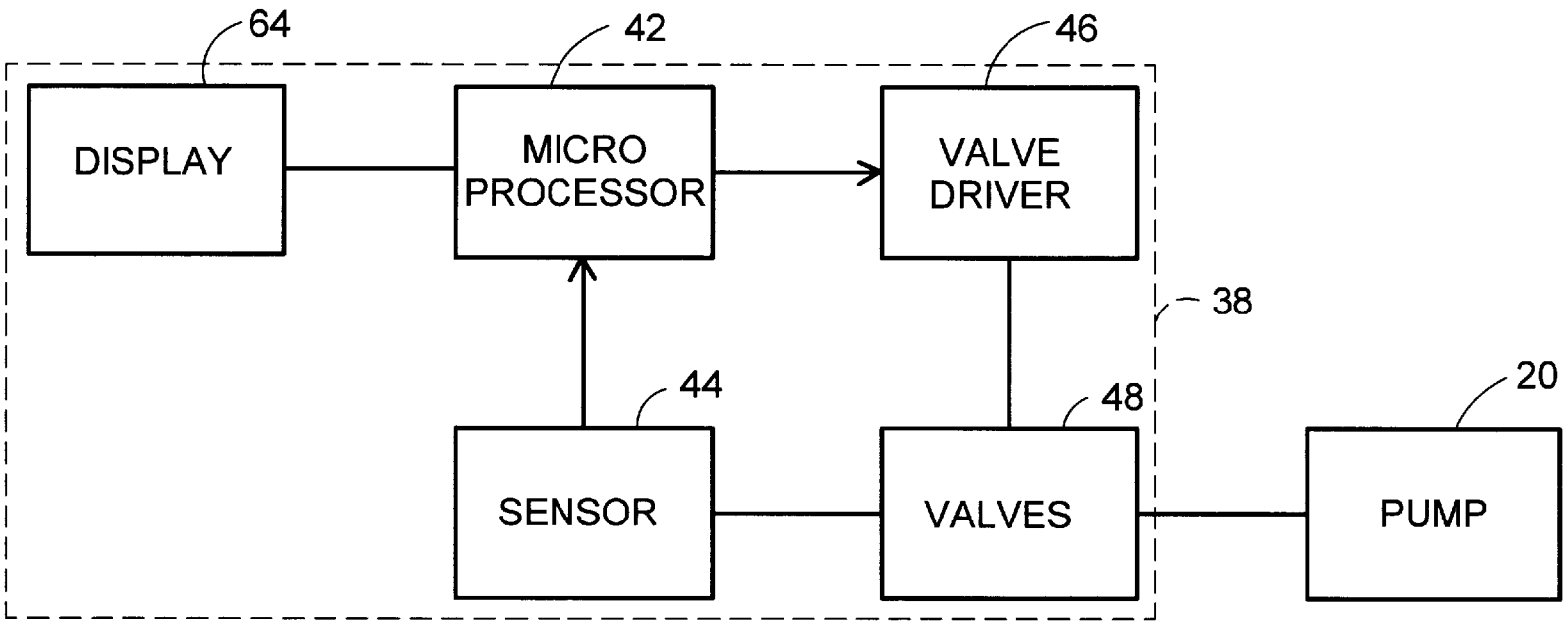
FIG. 7 shows an embodiment of the present invention that includes a display in addition to the elements shown in FIG. 2.

Reference is now made to FIG. 6 and FIG. 7 where there are shown box diagrams of other embodiments of the present invention. The embodiments shown in FIG. 6 and FIG. 7 are substantially the same as the embodiment shown in FIG. 2 with the exception of having additional elements. FIG. 6 shows an embodiment of the present invention that includes an analog-to-digital converter 60 in addition to the elements shown in FIG. 2. FIG. 7 shows an embodiment of the present invention that includes a display 64 in addition to the elements shown in FIG. 2.

A variety of additional configurations can be used for embodiments of the controller according to the present invention. In one embodiment, the controller includes a central processing unit (or equivalent information processing device) and associated equipment for executing computer program steps, and analog to digital converter for converting measurements into a form usable by the central processing unit, a valve driver for controlling operation of valves, a plurality of valves such as solenoid valves, a pressure regulator for controlling the amount of pressure applied for operation of the pump, pneumatic ports for making gas line connections, one or more pressure sensors, and one or more electrical ports for making electrical connections.

In a further embodiment, the controller includes a panel display for showing information about the status of the control process and the status of the pump. Preferably, the display panel is large enough so that the information can be viewed by an operator from a distance of several feet or more. In a still further embodiment, the controller is configured to receive or transmit information and instructions by remote control so as to provide easy set up of the parameters by using remote control. Controllers according to the standard technology typically do not have a display panel nor remote control capabilities, so it is more difficult to easily determine the status of the controller and pump when using the standard technology.

Using a microprocessor or similar device in the controller for embodiments of the present invention also provides the capability of controlling more than one pump using the same controller. The multiple pump control can be done substantially simultaneously. This means that the cost of ownership for performing photoresist delivery can be reduced because fewer controllers are needed and less cleanroom space is required.

An additional benefit of using embodiments of the present invention is the reduced operating cost for the photoresist delivery step as a result of optimizing the time allowed for the refill step. The features of the present invention that provide dynamic control of the refill time reduces the idle time for the photoresist pump and the photoresist pump controller. By avoiding the unnecessary waiting during the refill time, the use of utilities such as high purity inert gas and electric power consumption are reduced.

While there have been described and illustrated specific embodiments of the invention, it will be clear that variations in the details of the embodiments specifically illustrated and described may be made without departing from the true spirit and scope of the invention as defined in the claims and their legal equivalents.

What is claimed is:

1. A controller for operating a chemical dispense pump, the pump includes a diaphragm pump, the controller comprising:

a pressure sensor, the pressure sensor being connected with the pump so as to be capable of measuring pressures applied to the pump during the refill of the pump, the pressure sensor being capable of providing one or more signals indicating pressures;

a device capable of executing computer program instructions, the device being responsive to the pressure sensor;

at least one valve connected with the chemical dispense pump so as to allow pressure or vacuum to be applied to operate the pump, the valve being connected with the device so as to receive commands from the device;

the device being capable of actively monitoring and detecting completion of the refill of the pump in response to the signals from the pressure sensor, the controller being capable of terminating a refill step after completion of the refill of the pump.

2. The controller of claim 1 wherein the device comprises at least one of a microprocessor and a central processing unit.

3. The controller of claim 1 wherein the pressure sensor comprises a semiconductor pressure sensor capable of measuring sub-atmospheric pressures.

4. The controller of claim 1 further comprising a display panel for showing information about the status of the controller, the display panel being connected with the device so as to receive information from the device.

5. The controller of claim 1 wherein the device includes computer executable steps for detecting completion of refill in response to the signals from the sensor.

6. The controller of claim 5 wherein the controller is capable of detecting a failure in the pump in response to signals from the sensor and the controller is capable of providing an alarm and stopping the operation of the pump in response to the failure.

7. The controller of claim 1 further comprising a valve driver, the valve driver being connected with a device so as to receive commands from the device, the valve driver being connected with the at least one valve so that the valve driver can cause the valve to perform the commands from the device.

8. The controller of claim 1 further comprising an analog to digital converter, the converter being connected between the device and the pressure sensor so that analog signals received from the pressure sensor can be input to the device.

9. An apparatus for dispensing photoresist, the apparatus comprising:

a diaphragm pump;

a pressure sensor, the pressure sensor being connected with the pump so as to be capable of measuring pressures applied to the pump during refill of the pump, the pressure sensor being capable of providing one or more signals indicating pressures;

a controller comprising a microprocessor, the controller being responsive to the pressure sensor;

at least one valve connected with the pump so as to allow pressure or vacuum to be applied to operate the pump, the at least one valve being connected with the controller so as to receive commands from the controller;

the controller being capable of actively monitoring and detecting completion of the refill of the pump in response to the pressure sensor signal, the controller being capable of terminating a refill step after completion of the refill of the pump.

10. The apparatus of claim 9 wherein the controller is capable of detecting a failure in the pump in response to signals from the sensor and the controller is capable of providing an alarm and stopping the operation of the pump in response to the failure.

11. A controller for operating a diaphragm pump, the controller comprising:

a pressure sensor for measuring pressures applied to the pump during the refill of the pump;

a device for executing computer program instructions, the device being responsive to the pressure sensor;

at least one valve connected with the pump so as to allow pressure or vacuum to be applied to operate the pump, the at least one valve being connected with the device so as to receive commands from the device;

the device having executable instructions for actively monitoring and detecting completion of the refill of the pump in response to signals from the pressure sensor, the device having executable instructions for terminating a refill step after detecting the completion of the refill of the pump.

12. The apparatus of claim 11 wherein, the executable instructions for actively monitoring and detecting completion of the refill of the pump include the steps of:

a) monitoring the pressure applied to draw fluid into the pump during the refill step; and b) detecting completion of the refill step in response to changes in the monitored pressure.

13. The apparatus of claim 12 wherein step b comprises comparing the monitored pressure to a predetermined reference pressure.

14. The apparatus of claim 13 wherein completion of the refill step corresponds to having the level of vacuum for the monitored pressure exceed the level of vacuum for the reference pressure.

15. The apparatus of claim 12 wherein step b comprises approximating the time at which an inflection point occurs for the monitored pressure as a function of time.

16. The apparatus of claim 12 further comprising executable instructions for measuring a reference pressure during a prior dispense step so that the reference pressure is available for detecting completion of the refill step.

* * * * *